US010428620B2

(12) United States Patent
Coulston

(10) Patent No.: US 10,428,620 B2
(45) Date of Patent: Oct. 1, 2019

(54) REPLACEABLE DOWNHOLE ELECTRONIC HUB

(71) Applicant: Stephen Coulston, Houston, TX (US)

(72) Inventor: Stephen Coulston, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 150 days.

(21) Appl. No.: 15/657,464

(22) Filed: Jul. 24, 2017

(65) Prior Publication Data

US 2019/0024477 A1 Jan. 24, 2019

(51) Int. Cl.

| | |
|---|---|
| ***E21B 34/06*** | (2006.01) |
| ***E21B 47/01*** | (2012.01) |
| ***E21B 47/12*** | (2012.01) |
| ***E21B 23/03*** | (2006.01) |

(52) U.S. Cl.
CPC ..... *E21B 34/066* (2013.01); *E21B 23/03* (2013.01); *E21B 47/12* (2013.01)

(58) Field of Classification Search
CPC .... E21B 34/066; E21B 34/105; E21B 34/106; E21B 34/107; E21B 47/01; E21B 47/12; E21B 23/03
See application file for complete search history.

(56) References Cited

U.S. PATENT DOCUMENTS 4,480,687 A * 11/1984 Terral ..... E21B 23/03 166/117.5
6,321,842 B1 * 11/2001 Pringle ..... E21B 23/03 166/194
6,571,046 B1 * 5/2003 Hickey ..... E21B 17/003 385/134
6,644,403 B2 * 11/2003 Pichery ..... E21B 17/028 166/242.5
7,273,106 B2 * 9/2007 Huckabee ..... E21B 43/08 166/227
2004/0251048 A1 12/2004 Kurkoski
2013/0043048 A1 2/2013 Joseph
2013/0056222 A1 * 3/2013 Smith ..... E21B 17/1035 166/378
2013/0220602 A1 8/2013 Patwa et al.
2015/0337644 A1 11/2015 Mueller et al.
2018/0149002 A1 * 5/2018 Murdoch ..... E21B 43/123

FOREIGN PATENT DOCUMENTS

WO WO2017025351 A1 2/2017

OTHER PUBLICATIONS

International Search Report and Written Opinion for International Application No. PCT/US2018/038491; International Filing Date Jun. 20, 2018; dated Oct. 23, 2018 (pp. 1-12).

* cited by examiner

*Primary Examiner* — Kenneth L Thompson
(74) *Attorney, Agent, or Firm* — Cantor Colburn LLP

(57) ABSTRACT

A tubular system includes a tubular having an outer surface and an inner surface defining a flow path, one of the inner surface and the outer surface includes a hub receiving recess, and an electronics hub detachably mounted in the hub receiving recess, the electronics hub including an input conductor connector and at least one output conductor connectors and a control module that facilitates communication between a surface system and one or more downhole devices.

18 Claims, 4 Drawing Sheets

REPLACEABLE DOWNHOLE ELECTRONIC HUB

BACKGROUND

Resource exploration and recovery systems typically employ a string of tubulars that extends into a wellbore. The string of tubulars may be utilized to extract resources, treat a formation or perform other operations downhole. Various downhole tools, sensors and other devices are utilized during downhole operations. For example, an inflow control device (ICD) may be employed to control flow of a downhole fluid into the string of tubulars. Activation and control of the various downhole tools, sensors and other devices it typically established through a wireline that extends from a surface system to the particular downhole device.

Over time, a downhole device may experience an electronic failure or may benefit from, for example, an electrical upgrade. In such cases, it is necessary to withdraw the string of tubulars from the wellbore and make any desired changes. Once the repair or upgrade is complete, the string of tubulars is then run back into the wellbore. Withdrawing a string of tubulars from a wellbore and subsequently running the string of tubulars back downhole is a costly time consuming process.

Alternatively, the downhole devices may be retrievable without pulling the string of tubulars. In this case, multiple intervention trips are required if a plurality of electrical devices are to be replaced, repaired or upgraded. Each device being independently retrievable would require one trip to retrieve and one to replace.

SUMMARY

A tubular system includes a tubular includes an outer surface and an inner surface defining a flow path, one of the inner surface and the outer surface includes a hub receiving recess, and an electronics hub detachably mounted in the hub receiving recess. The electronics hub includes an input conductor connector and at least one output conductor connectors and a control module that facilitates communication between a surface system and one or more downhole devices.

A resource recovery and exploration system includes a surface system, a downhole system including a string of tubulars, at least one of the string of tubulars includes an outer surface and an inner surface defining a flow path, one of the inner surface and the outer surface including a hub receiving recess, and an electronics hub detachably mounted in the hub receiving recess. The electronics hub includes an input conductor connector and at least one output conductor connectors and a control module that facilitates communication between a surface system and one or more downhole devices.

BRIEF DESCRIPTION OF THE DRAWINGS

Referring now to the drawings wherein like elements are numbered alike in the several Figures.

DETAILED DESCRIPTION

Figure 1:
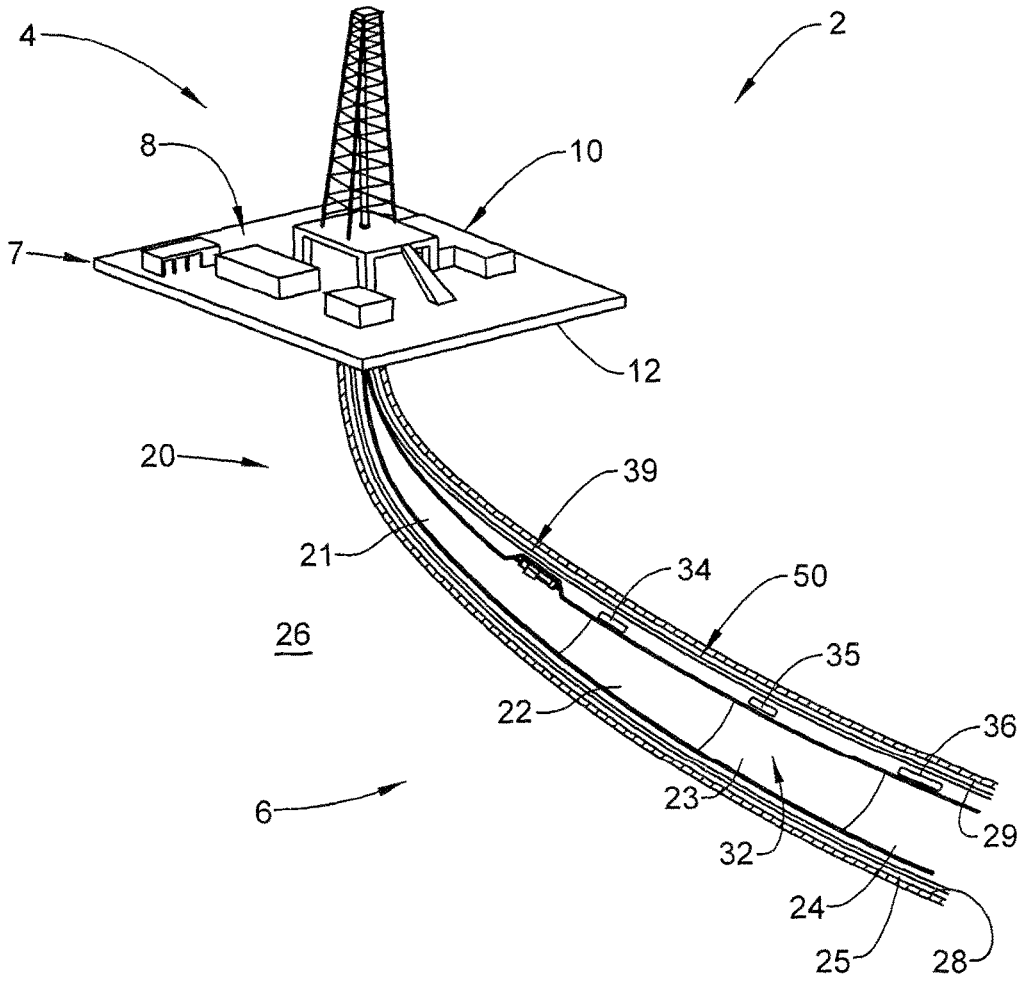
FIG. 1 depicts a resource exploration and recovery system including a replaceable downhole electronics hub, in accordance with an exemplary embodiment.
Figure 2:
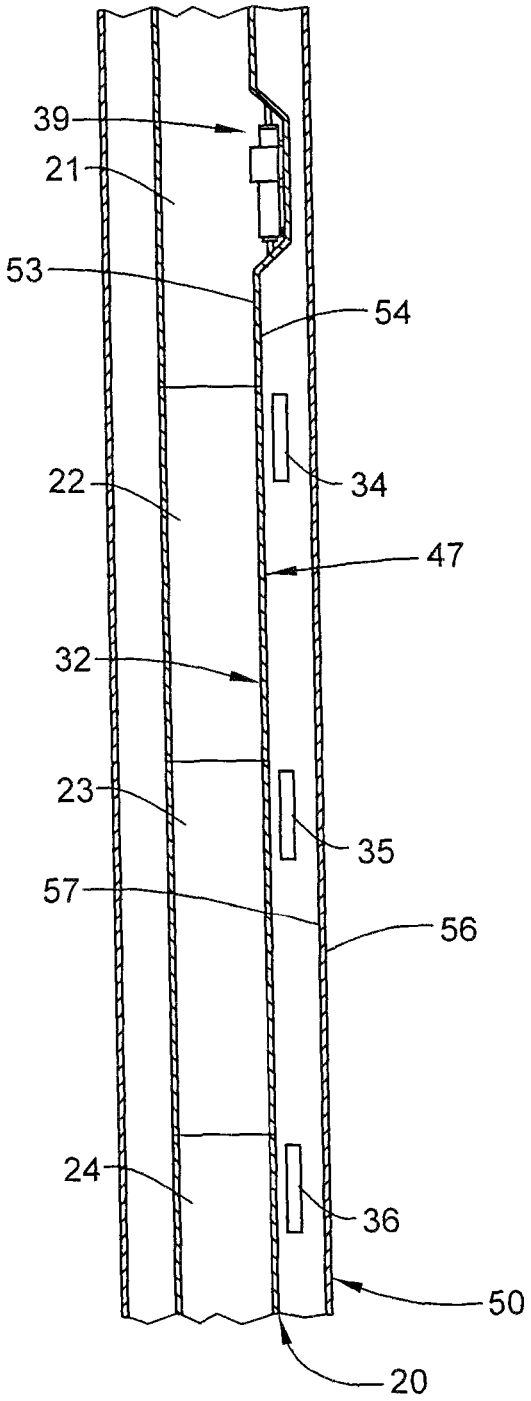
FIG. 2 depicts a tubular including the replaceable downhole electronics hub, in accordance with an aspect of an exemplary embodiment.

A resource exploration and recovery system, in accordance with an exemplary embodiment, is indicated generally at 2, in FIGS. 1 and 2. Resource exploration and recovery system 2 should be understood to include well drilling operations, resource extraction and recovery, $CO_2$ sequestration, and the like. Resource exploration and recovery system 2 may include a surface system 4 operatively connected to a downhole system 6. Surface system 4 may include pumps 8 that aid in completion and/or extraction processes as well as fluid storage 10. Fluid storage 10 may contain a gravel pack fluid or slurry (not shown) or other fluid which may be introduced into downhole system 6. Surface system 4 may also include a control system 12 that may monitor and/or activate one or more downhole operations.

Downhole system 6 may include a downhole string 20 formed from a plurality of tubulars, three of which is indicated at 21, 22, 23 and 24 that is extended into a wellbore 25 formed in formation 26. Wellbore 25 includes an annular wall 28 that may be defined by a wellbore casing 29 provided in wellbore 25. Of course, it is to be understood, that annular wall 28 may also be defined by formation 26.

In the exemplary embodiment shown, downhole system 6 may include a number of downhole devices 32 such as, for example, a first inflow control device (ICD) 34 arranged at tubular 22, a second ICD 35 arranged at tubular 23, and a third ICD 36 arranged at tubular 24. ICD's 34, 35, and 36 may be selectively operated to equalize reservoir inflow to string of tubulars 20 along a length of wellbore 25. Each ICD 34, 35, and 36 may be controlled to a specific setting to partially choke flow and establish a selected flow equalization. It is, however, to be understood, that the number and type of downhole devices 32 may vary. In accordance with an exemplary embodiment, tubular 21 supports a selectively replaceable electronics hub 39 that serves as downhole interface between control system 12 and downhole devices 32 as will be detailed below. It should be understood that downhole devices 32 may take on a variety of forms and should not be considered to be limited to ICD's.

Figure 3:
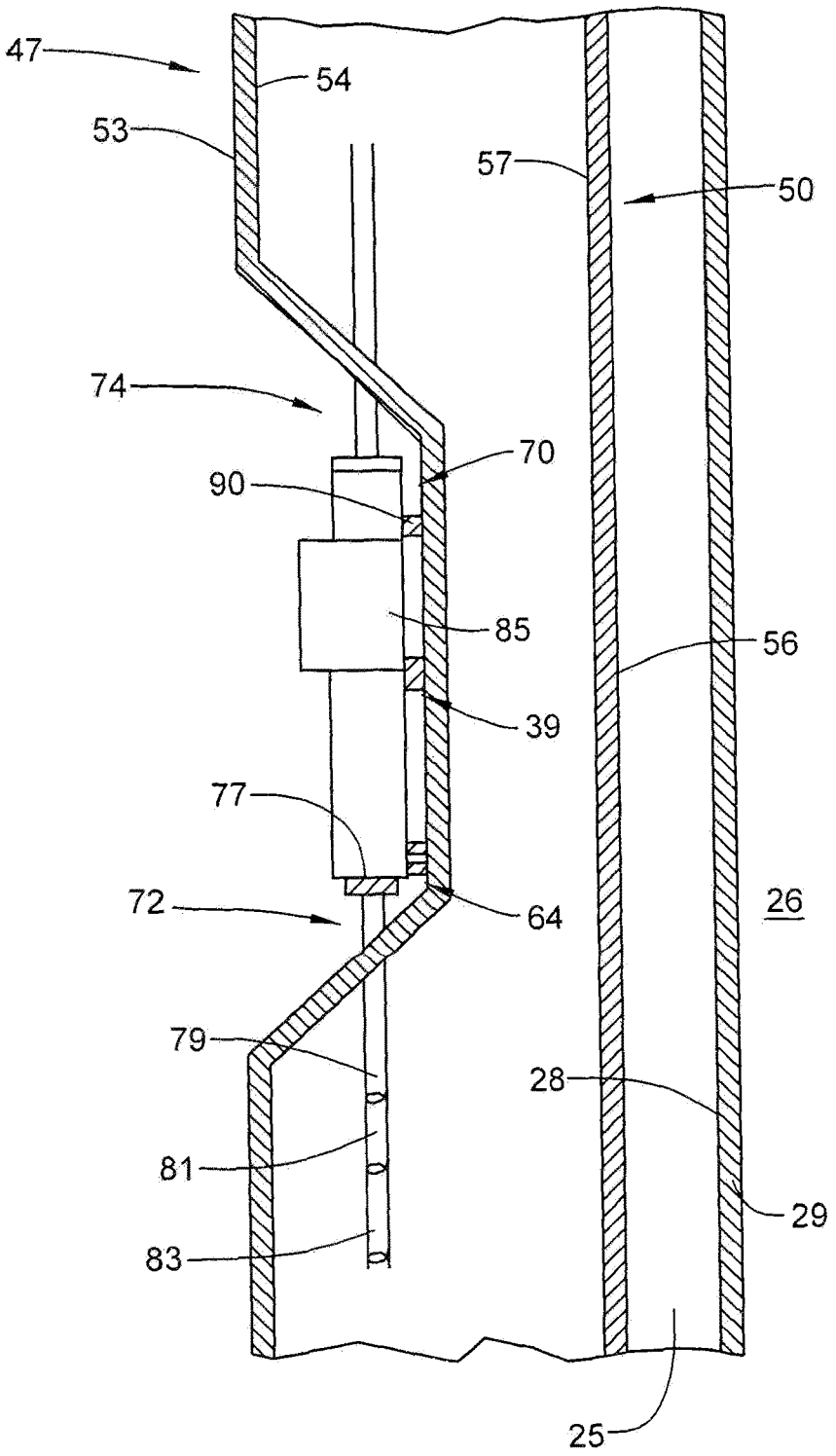
FIG. 3 depicts the replaceable downhole electronics hub, in accordance with an aspect of an exemplary embodiment.

With reference to FIG. 3 and continued reference to FIGS. 1 and 2, tubular 21 is shown to include a first or inner tubular 47 and a second or outer tubular 50. Second tubular 50 is disposed radially outwardly of, and spaced from, first tubular 47. First tubular 47 includes an inner surface 53 and an outer surface 54. Second tubular 50 includes an outer surface section 56 and an inner surface section 57. In accordance with an exemplary aspect, first tubular 47 includes a hub receiving recess 64 that is receptive of selectively replaceable electronics hub 39. It is to be understood that hub receiving recess 64 may also be disposed in inner surface section 57 of second tubular 50.

In accordance with an exemplary embodiment, selectively replaceable electronics hub 39 includes an input conductor connector 70 and an output conductor connector 72. Input conductor connector 70 may be a connector receptive of an input control line 74. Output conductor connector 72 may take the form of a multi-line connector 77 receptive of a first control line member 79, a second control line member 81 and a third control line member 83. First control line member 79 may extend to and connect with ICD 34, second control line member 81 may extend to and connect with ICD 35, and third control line member 83 may extend to and connect with ICD 36. Both input conductor connector 70 and output conductor connector 72 may take the form of wet connectors. As will be detailed herein, input control line 74 and control line members 79, 81, and 83 may take on a variety of forms including electric conductors, hydraulic conductors and digital communication lines.

In accordance with an aspect of an exemplary embodiment, selectively replaceable electronics hub 39 includes a control module 85 that may pass input commands received from control system 12 to downhole devices 32 and may also pass feedback from downhole devices 32 back to control system 12. In accordance with an exemplary aspect, control module 85 may take the form of an analog electronic control module that receives and outputs analog electric control signals, a hydraulic control module that receives and outputs hydraulic control signals, an optical control module that received and outputs optical signals, or a digital communication module that receives and outputs digital communication signals, and a hybrid control module that may include aspects of one or more of the electronic control module, hydraulic control module, optical control module and the digital control module. For example, control module 85 may receive electrical signals from control system 12 and output hydraulic control signals to downhole devices. It should also be understood that control module 85 may receive inputs from downhole devices and transmit those inputs to uphole and/or to control system 12.

In accordance with another aspect of an exemplary embodiment, selectively replaceable electronics hub 39 is secured in hub receiving recess 64 by a wireline lock 90. Wireline lock 90 may be manipulated by a wireline tool (not shown) to selectively release selectively replaceable electronics hub 39 while downhole. In this manner, selectively replaceable electronics hub 39 may be disconnected, retrieved to surface system 4, updated with new software, hardware and/or firmware or replaced. Selectively replaceable electronics hub 39 may then be reconnected in hub receiving recess 64 and operatively coupled to input control line 74 and control line members 79, 81, and 83. In this manner, selectively replaceable electronics hub 39 may be maintained, updated, and or replaced without the need to withdraw downhole string 20 from wellbore 24.

Figure 4:
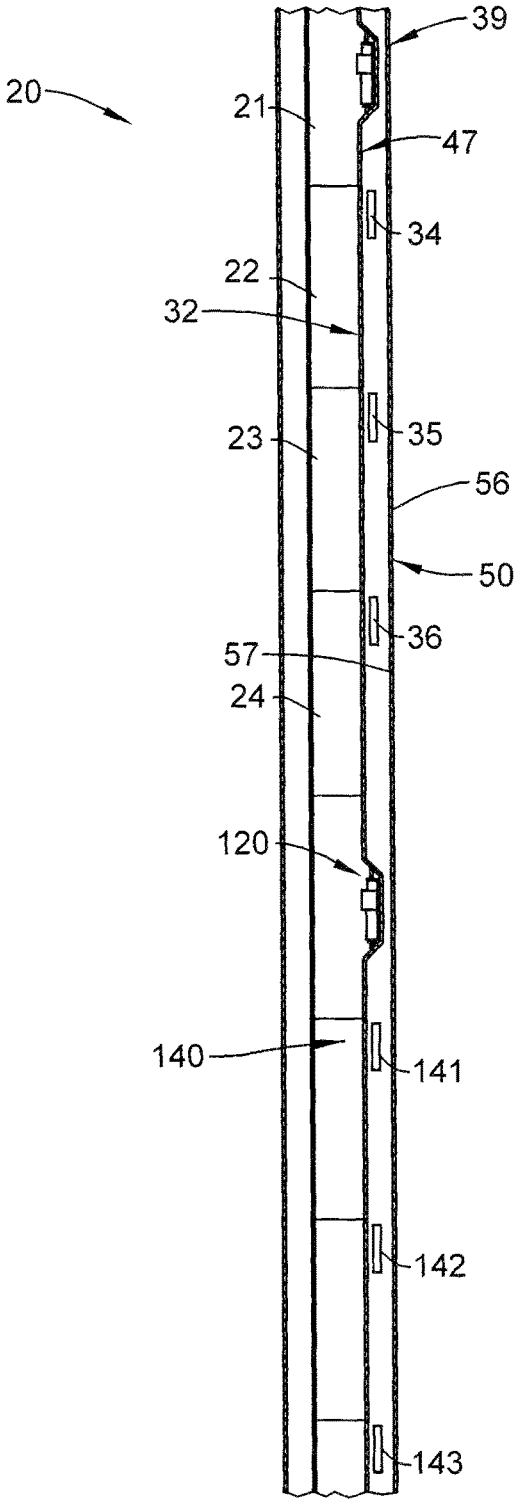
FIG. 4 depicts first and second replaceable downhole electronics hubs, in accordance with another aspect of an exemplary embodiment.

It is to be understood that the number of selectively replaceable electronics hubs arranged along downhole string 20 may vary. As shown in FIG. 4, downhole string 20 may include selectively replaceable electronics hub 39 as well as another selectively replaceable electronics hub 120 connected to another tubular 125. In this manner, input control line 74 may include a first branch conductor 128 coupled to selectively replaceable electronics hub 39 and a second branch conductor 130 coupled to another selectively replaceable electronics hub 120. Another selectively replaceable electronics hub 120 may be coupled to additional downhole devices 140 such as an ICD 141, an ICD 142, and an ICD 143 arranged downhole. It should be understood that downhole devices 140 may take on a variety of forms and should not be considered to be limited to ICD's.

Set forth below are some embodiments of the foregoing disclosure:

A tubular system including a tubular including an outer surface and an inner surface defining a flow path, one of the inner surface and the outer surface including a hub receiving recess, and an electronics hub detachably mounted in the hub receiving recess, the electronics hub including an input conductor connector and at least one output conductor connectors and a control module that facilitates communication between a surface system and one or more downhole devices.

The tubular system as in any prior embodiment, wherein the control module is an electronics control module operable to provide an electrical output through the at least one output conductor connector in response to an input received through the input conductor connector.

The tubular system as in any prior embodiment, wherein the control module is a hydraulics control module operable to provide a hydraulic output through the at least one output conductor connector in response to an input received through the input conductor connector.

The tubular system as in any prior embodiment, wherein the control module is an optical control module operable to receive a data through the at least one output conductor connector and transmit this through the input conductor connector.

The tubular system as in any prior embodiment, wherein the hub receiving recess is formed in the inner surface.

The tubular system as in any prior embodiment, further comprising: a wireline lock operatively connecting the electronics hub and the one of the tubular.

The tubular system as in any prior embodiment, wherein the at least one output conductor connector includes a multi-line output conductor connector.

A resource recovery and exploration system including a surface system, a downhole system including a string of tubulars, at least one of the string of tubulars including an outer surface and an inner surface defining a flow path, one of the inner surface and the outer surface including a hub receiving recess, and an electronics hub detachably mounted in the hub receiving recess, the electronics hub including an input conductor connector and at least one output conductor connectors and a control module that facilitates communication between a surface system and one or more downhole devices.

The resource recovery and exploration system as in any prior embodiment, wherein the control module is an electronics control module operable to provide an electrical output through the at least one output conductor connector in response to an input received through the input conductor connector.

The resource recovery and exploration system as in any prior embodiment, wherein the control module is a hydraulics control module operable to provide a hydraulic output through the at least one output conductor connector in response to an input received through the input conductor connector.

The resource recovery and exploration system as in any prior embodiment, 8, wherein the control module is an optical control module operable to receive a data through the at least one output conductor connector and transmit this through the input conductor connector.

The resource recovery and exploration system as in any prior embodiment, wherein the hub receiving recess is formed in the outer surface.

The resource recovery and exploration system as in any prior embodiment, further comprising: a wireline lock operatively connecting the electronics hub and the one of the string of tubulars.

The resource recovery and exploration system as in any prior embodiment, further comprising: a control line extending from the surface system to the input conductor connector of the electronics hub.

The resource recovery and exploration system as in any prior embodiment, wherein the control line comprises one of a hydraulic control line, an electrical conductor, a fiber optic and a digital communication conductor.

The resource recovery and exploration system as in any prior embodiment, wherein another one of the string of tubulars arranged downhole relative to the at least one of the string of tubulars includes a device operatively connected to the at least one output conductor connector through a control line member.

The resource recovery and exploration system as in any prior embodiment, wherein the device comprises an inflow control device (ICD).

The resource recovery and exploration system as in any prior embodiment, wherein the at least one output conductor connector includes a multi-line output conductor connector.

The resource recovery and exploration system as in any prior embodiment, wherein a first one of the string of tubulars arranged downhole relative to the at least one of the tubulars includes a first device operatively connected to multi-line output conductor connector through a first control line member and a second one of the string of tubulars arranged downhole relative to the at least one of the tubulars includes a second device operatively connected to the multi-line output conductor connector through a second control line member.

The resource recovery and exploration system as in any prior embodiment, further comprising: another tubular arranged radially outwardly of the at least one of the string of tubulars.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubular system comprising:

a tubular including an outer surface and an inner surface defining a flow path, one of the inner surface and the outer surface including a hub receiving recess; and an electronics hub detachably mounted in the hub receiving recess, the electronics hub including an input conductor connector, at least one output conductor connector, and a control module that facilitates communication between a surface system and one or more downhole devices, wherein the control module is one of a hydraulics control module operable to provide a hydraulic output through the at least one output conductor connector in response to an input received through the input conductor connector and an optical control module operable to receive a data through the at least one output conductor connector and transmit this through the input conductor connector.

2. The tubular system according to claim 1, wherein the control module is an electronics control module operable to provide an electrical output through the at least one output conductor connector in response to an input received through the input conductor connector.

3. The tubular system according to claim 1, wherein the control module is a hydraulics control module.

4. The tubular system according to claim 1, wherein the control module is an optical control module.

5. The tubular system according to claim 1, wherein the hub receiving recess is formed in the inner surface.

6. The tubular system according to claim 1, further comprising: a wireline lock operatively connecting the electronics hub and the one of the tubular.

7. The tubular system according to claim 1, wherein the at least one output conductor connector includes a multi-line output conductor connector.

8. A resource recovery and exploration system comprising:

a surface system;

a downhole system including a string of tubulars, at least one of the string of tubulars including an outer surface and an inner surface defining a flow path, one of the inner surface and the outer surface including a hub receiving recess;

an electronics hub detachably mounted in the hub receiving recess, the electronics hub including an input conductor connector and at least one output conductor connectors and a control module that facilitates communication between a surface system and one or more downhole devices; and a control line extending from the surface system to the input conductor connector of the electronics hub, wherein the control line comprises one of a hydraulic control line, an electrical conductor, a fiber optic and a digital communication conductor.

9. The resource recovery and exploration system according to claim 8, wherein the control module is an electronics control module operable to provide an electrical output through the at least one output conductor connector in response to an input received through the input conductor connector.

10. The resource recovery and exploration system according to claim 8, wherein the control module is a hydraulics control module operable to provide a hydraulic output through the at least one output conductor connector in response to an input received through the input conductor connector.

11. The resource recovery and exploration system according to claim 8, wherein the control module is an optical control module.

12. The resource recovery and exploration system according to claim 8, wherein the hub receiving recess is formed in the outer surface.

13. The resource recovery and exploration system according to claim 8, further comprising: a wireline lock operatively connecting the electronics hub and the one of the string of tubulars.

14. The resource recovery and exploration system according to claim 8, wherein another one of the string of tubulars arranged downhole relative to the at least one of the string of tubulars includes a device operatively connected to the at least one output conductor connector through a control line member.

15. The resource recovery and exploration system according to claim 8, wherein the device comprises an inflow control device (ICD).

16. The resource recovery and exploration system according to claim 8, wherein the at least one output conductor connector includes a multi-line output conductor connector.

17. The resource recovery and exploration system according to claim 16, wherein a first one of the string of tubulars arranged downhole relative to the at least one of the tubulars includes a first device operatively connected to multi-line output conductor connector through a first control line member and a second one of the string of tubulars arranged downhole relative to the at least one of the tubulars includes a second device operatively connected to the multi-line output conductor connector through a second control line member.

18. The resource recovery and exploration system according to claim 8, further comprising: another tubular arranged radially outwardly of the at least one of the string of tubulars.

* * * * *